US006720546B1

(12) United States Patent
Foret et al.

(10) Patent No.: US 6,720,546 B1
(45) Date of Patent: Apr. 13, 2004

(54) METHOD AND DEVICE FOR DETECTING A TRUE PRODUCT JAM IN A FOLDER

(75) Inventors: Francoise Marie Foret, Chambly (FR); Didier Marcel Rousseau, Point Ste Maxence (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 103 days.

(21) Appl. No.: 09/671,823

(22) Filed: Sep. 27, 2000

(30) Foreign Application Priority Data

Sep. 27, 1999 (DE) ..... 199 46 190
May 23, 2000 (FR) ..... 00 06554

(51) Int. Cl.[7] ..... B65H 7/02
(52) U.S. Cl. ..... 250/223 R; 250/559.4; 271/259
(58) Field of Search ..... 250/559.4, 223 R, 250/222.1; 271/258.01, 259

(56) References Cited

U.S. PATENT DOCUMENTS 4,275,879 A * 6/1981 Yamashita et al. ..... 271/259
4,310,153 A * 1/1982 Kikuchi ..... 250/223 R
4,763,160 A * 8/1988 Honjo ..... 355/3 SH
4,997,217 A 3/1991 Kunze ..... 285/387
5,262,823 A * 11/1993 Nakajima et al. ..... 355/205
5,280,322 A * 1/1994 Kono ..... 399/22
5,516,094 A * 5/1996 Sander ..... 250/223 R
5,970,274 A * 10/1999 Rath ..... 399/21

FOREIGN PATENT DOCUMENTS

| | | |
|---|---|---|
| EP | 0 168 202 A1 | 1/1986 |
| EP | 0 342 647 A2 | 11/1989 |
| EP | 0 933 321 A2 | 8/1999 |
| FR | 2 492 349 | 4/1982 |
| JP | 05 026 379 A | 2/1993 |
| JP | 05 026 381 A | 2/1993 |

* cited by examiner

*Primary Examiner*—Stephone B. Allen
(74) *Attorney, Agent, or Firm*—Laurence A. Greenberg; Werner H. Stemer; Ralph E. Locher

(57) ABSTRACT

A method for detecting a copy jam or buildup in a folder uses sensors assigned to a copy transport path for determining a sequence of copies along the copy transport path. The sensors are formed of a transmitting part and a receiving part, and the method includes having the sensors release an input signal to a paper jam-detection device in response to the presence of copies detected by the receiving parts of the sensors. The input signal produces a counting pulse. A system for performing the method and a folder including the system are also provided.

12 Claims, 4 Drawing Sheets

METHOD AND DEVICE FOR DETECTING A TRUE PRODUCT JAM IN A FOLDER

BACKGROUND OF THE INVENTION

Field of the Invention

The invention relates to a method and a device for detecting a true product jam in a folder.

Japanese Patent JP 5 26382 discloses a device for detecting a paper jam or buildup in a folder. In this heretofore-known device from the state of the art, a sensor is disposed at a defined location in the folder along the copy transport path, and detects the presence of folded products transported along the path. When the results of the detection show that a paper jam or buildup is occurring at the aforementioned defined location, the rotary printing machine must be stopped. In the improvement in the art presented in this Japanese patent, a test mode is provided, wherein cutoff functions can be simulated, but the cutoff function which brings the rotary printing machine to a stop is blocked. It is thus possible to check whether or not a safety cutoff is functioning reliably as is required when a paper jam is detected in a folder downline of a rotary printing machine. Japanese Patent JP 5 26381 discloses a device for detecting a paper jam or buildup in a folder, wherein a sensor is likewise arranged at a defined location along the folded-copy transport path. The sensor detects the presence of copies transported along the path and, based upon the detection results, establishes that there is a paper jam at the respective location at which the sensor is integrated into the transport path of the copies. Care is taken to ensure that, when the power source is applied, different signals are emitted in a case wherein the sensor is connected to the main circuit and in a case wherein the sensor is separated from the main circuit.

Finally, Japanese Patent JP 5 26379 discloses a further device for locating a paper jam or buildup in a folder. This device is equipped with sensors which are likewise arranged at defined locations, in order to detect the presence of copies transported along the folded-copy transport path. Facilities are provided for deciding whether or not, based upon the results of detection by the sensors, there is a paper jam at the respective location. Furthermore, indicators are provided for indicating a paper jam, based upon the decision of the aforementioned decision-making facilities. The indicators include memories which maintain the indication of a paper jam and which, when a paper jam is present, cause only that location to appear on an indicator at which a paper jam was first indicated as being present by the aforementioned decision-making facilities.

In copy-processing machines, for example, a rotary printing machine with a downline folder, copy jam or buildup detection is based upon an evaluation of the number of cutting-cylinder revolutions, and an evaluation of the copies seen and correspondingly counted along the copy transport path by the sensor cells. When detached paper shreds or copy fragments move through the folder, which may be swirled around by airflows, these may falsely suggest the occurrence of a copy jam or buildup, even though no copy jam or buildup exists This may be due to the fact that the paper shreds cover a sensor cell in such a way that the sensor cell can no longer reliably count the folded copies passing per unit time. In individual instances, detached pieces of paper or paper shreds have been counted as intact copies by the sensor technology within a folder. A comparison of the counted copies with the copies actually counted off from the incoming material web by the pair of cutting cylinders has led to implausible results.

SUMMARY OF THE INVENTION

In view of the prior art outlined it is accordingly an object of the invention to provide a device for detecting a true product jam or build-up in a folder and, more particularly, sensor technology for ensuring a correct indication of a copy jam or buildup.

With the foregoing and other objects in view, there is provided, in accordance with one aspect of the invention, a method for detecting a copy jam or buildup in a folder, by sensors assigned to a copy transport path for determining a sequence of copies along the copy transport path, the sensors, respectively, being formed of a transmitting part and a receiving part, which comprises having the sensors release an input signal to a paper jam-detection device, in response to the presence of copies detected by the receiving parts of the sensors; and having the input signal produce a counting pulse.

In accordance with another mode, the method of the invention includes providing the paper jam-detection system with inverting inputs for triggering the counting pulse when there is no voltage at the receiving parts.

In accordance with a further mode, the method of the invention includes continuously sensing the edge regions of the copies with the sensors.

In accordance with an added mode, the method of the invention includes comparing the number of revolutions of a cutting-cylinder pair with the number of copies passing the sensors for determining a paper jam in the folder.

In accordance with an additional mode, the method of the invention includes failing to release a counting pulse when the input signal at the paper jam-detection device is based upon a voltage signal from only one of the receiving parts.

In accordance with a further aspect of the invention, there is provided a system for detecting a copy jam in a folder by sensors assigned to a copy transport path for detecting a sequence of copies along the copy transport path, comprising a parallel-connected arrangement of the sensors wherein the sensors are assigned to edge regions of the copies, and serve simultaneously for sensing the copy transport path.

In accordance with an added feature of the system of the invention, the sensors, respectively, include both a transmitting part and a receiving part.

In accordance with an additional feature of the system of the invention, the sensors, respectively, are connected at one voltage level and have a live voltage-carrying output.

In accordance with yet another feature of the system of the invention, the voltage-carrying outputs are combined for generating an input signal to the paper jam-detection device.

In accordance with yet a further feature of the system of the invention, the receiving parts include switching elements and identical open contact positions for generating a counting pulse at the paper jam-detection device.

In accordance with yet an added feature of the invention, at least one closed contact on the receiving parts serves for generating an input signal which does not trigger a paper jam detection.

In accordance with a concomitant aspect of the invention, there is provided a folder with a copy transport path, along which copies are transported in a continuous sequence, and sensors assigned to the copy transport path, the sensors, respectively, including a transmitting and a receiving part, comprising at least one parallel-connected sensor pair arrangement provided along the copy transport path for sensing the copy transport path simultaneously with producing combinable output signals by the receiving parts of the sensor-pair arrangement.

Thus, by the further developments proposed in accordance with the invention, in the detection of a paper jam or buildup, a counting pulse is triggered only when both sensors indicate the presence of a folded or foldable copy to be transported. Paper shreds or detached product fragments are detected as such and, when they enter the field of detection of one of the sensors, do not generate a counting pulse in the paper jam or buildup detection-device. There is therefore no false indication of a paper jam or buildup; if one of the sensors of a sensor pair fails, the rotary printing machine can nevertheless continue to operate with minimal wiring changes, and the paper jam or buildup-detection device continues to be active.

If the paper jam or buildup-detection device has inverting inputs in order to increase redundancy, a counting pulse is triggered in the paper jam or buildup-detection device whenever there is no voltage at the receiving parts of the sensors of the sensor pair. In this case, both sensors of the respective pair see a folded or foldable copy, and this is detected as such and is counted correspondingly. The sensor pairs are oriented along the copy transport path in a manner that they preferably detect edge regions of the folded or foldable copies conveyed in rapid sequence and are arranged eccentrically with respect to the copy transport path. In order to detect a copy jam or buildup, the paper jam or buildup-detection device continuously compares the numbers of revolutions of the cutting-cylinder pair with the number of counted copies.

The sensors, respectively, include a transmitting and a receiving part. Radiation is emitted continuously from the transmitting part to the receiving part, and the two sensors of the sensor pair are connected in parallel. The sensors are at one voltage level and include electric contact elements which, when both sensors detect folded or foldable copies, remain open and trigger a counting pulse on the paper jam or buildup-detection device by inverted inputs thereat. Where a contact of one of the sensors of the sensor pair is closed, no counting pulse is generated, and the paper jam or buildup-detection device remains inactive.

The method according to the invention can be employed in folders both for newsprinting and for job printing, whether on folders with sets of pins or on folders operating without pins.

Other features which are considered as characteristic for the invention are set forth in the appended claims.

Although the invention is illustrated and described herein as embodied in a method and device for detecting a true product jam or buildup in a folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

Figure 1:
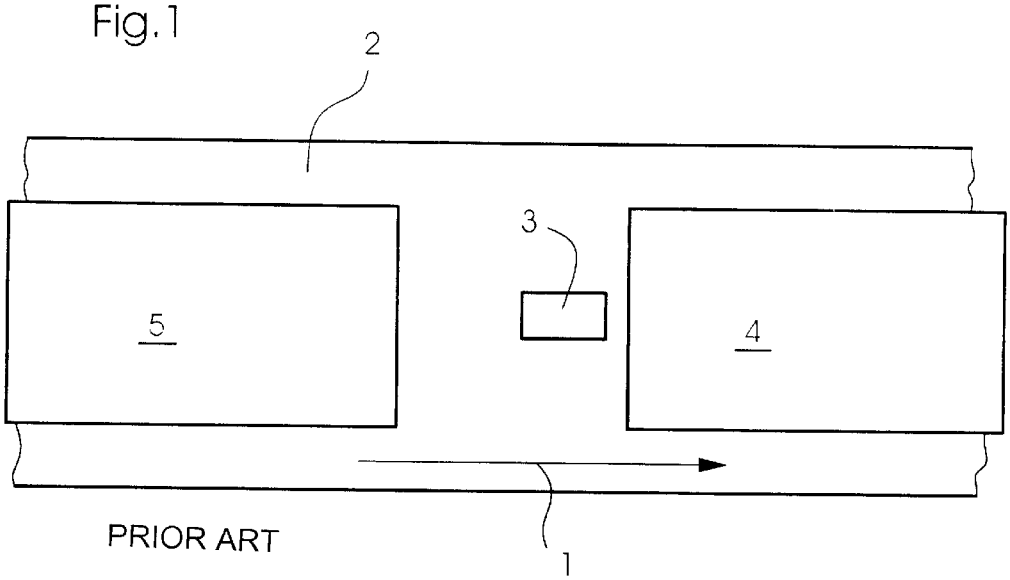
FIG. 1 is a diagrammatic top plan view of a sensor device known from the prior art, which is disposed along a copy transport path.

As noted hereinbefore, in the illustration according to FIG. 1, a configuration that has become known from the prior art is shown.

DESCRIPTION OF THE PREFERRED EMBODIMENTS

Referring now specifically to the drawings, and particularly to FIG. 1 showing the device of the prior art, folded or foldable copies 4 and 5 are conveyed in a copy transport direction represented by the arrow 1. Provided in a device which is somewhat central to a copy transport path 2 is a sensor 3 past which a counted copy 4 has been transported, followed by a further folded or foldable copy 5 which is yet to be counted. Whether the sensor 3 disposed centrally to the copy transport path 2 detects a folded or foldable copy, or a part thereof, a fragment or a paper shred as a copy cannot be stated with certainty, because no redundant capability for checking the signal determined by the sensor 3 is provided.

The sensor 3 generates a counting pulse even when the sensor 3 is covered or concealed by paper shreds; the addition of pulses obtained in this manner and the comparison thereof regularly leads to the situation wherein the counted pulses exceed the number of cutting-cylinder revolutions which indicate, respectively, that a folded or foldable copy has been detached from the incoming material web, and a paper jam or buildup is detected, even though no such paper jam or buildup is present.

Figure 2:
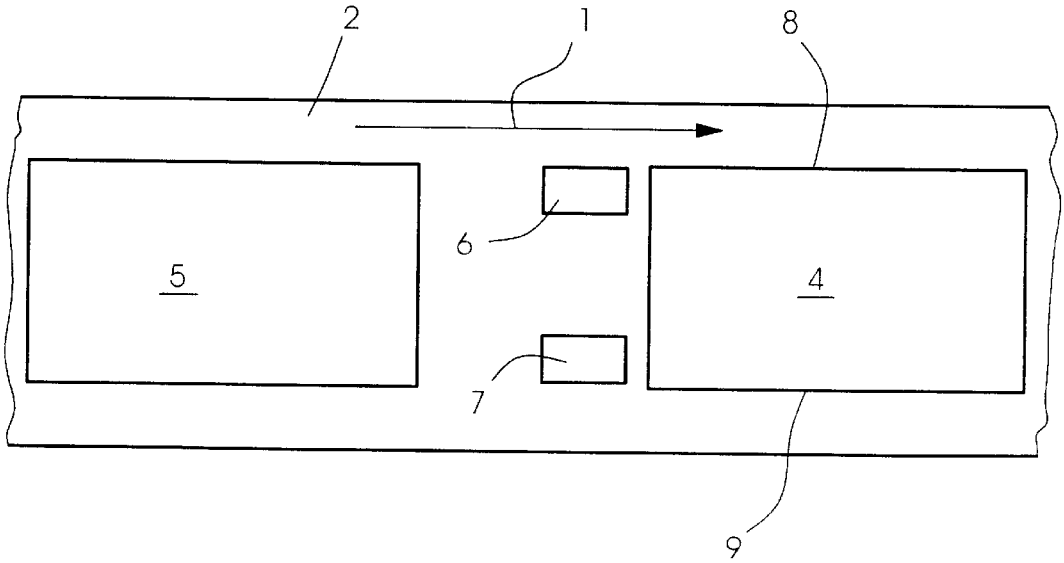
PRIOR ART Fig.2
FIG. 2 is a view like that of FIG. 1 of sensor devices arranged in parallel with one another for sensing edge regions of copies.

In the configuration according to FIG. 2, a device according to the invention is provided which is formed of a sensor pair including the sensors 6 and 7 which are assigned, respectively, to edge regions 8 and 9 of the conveyed folded or foldable copies 4 and 5. The sensors 6 and 7 are energized in parallel, and continuously and simultaneously sense the copy transport path 2 in the copy transport direction 1. So that the sensor technology detects a folded or foldable copy as such, both sensors 6 and 7 must detect "paper" simultaneously, with the result that corresponding signals are generated for the paper jam or buildup-detection system 12 (note FIGS. 3 and 4).

Figure 3:
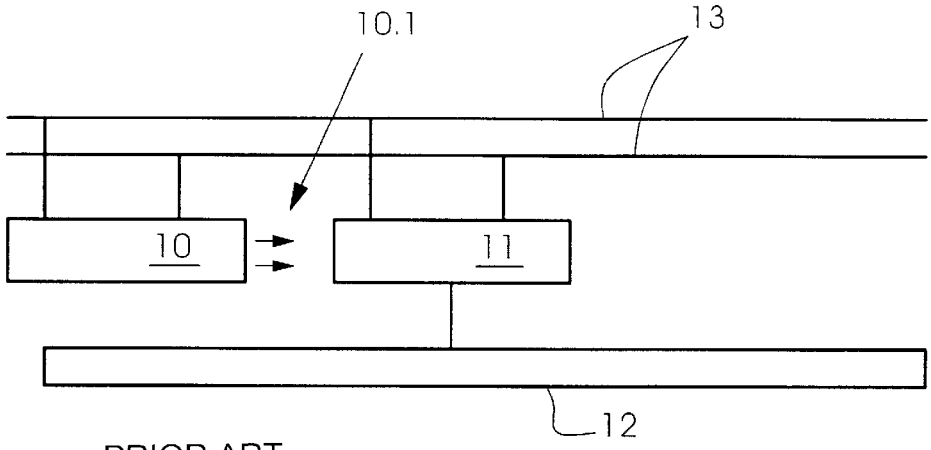
FIG. 3 is a schematic and diagrammatic view of transmitting and receiving parts of a conventional sensor device, which are connected to an evaluation unit.

In known sensor devices according to FIG. 3, the sensor 3, disposed centrally in the copy transport path 2 and formed of a transmitting part 10 and a receiving part 11, was energized permanently via supply lines 13. Between the transmitting part 10 and the receiving part 11, radiation 10.1 is exchanged, which indicates the detection of a folded or foldable copy, or implies the absence of a folded or foldable copy.

Figure 4:
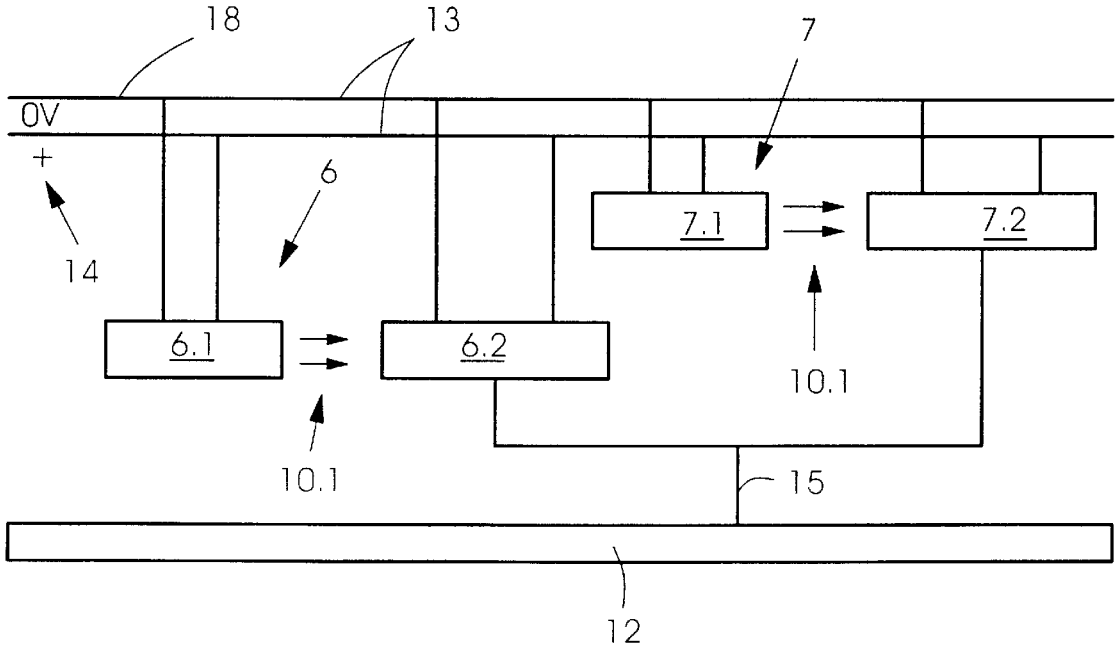
PRIOR ART Fig.4
FIG. 4 is a view like that of FIG. 3 of a sensor device according to the invention wherein signal indicators of two receiving parts are connected to the evaluation unit.

According to FIG. 4, the configuration according to the invention then includes two parallel-connected sensors 6 and 7. The pairs of sensors may be arranged along the copy transport path 2 through a folder 23 (note FIG. 6) at the critical location along the copy transport path 2, in particular at a pair of cutting cylinders 24 and at the transfer points of the cylinders guiding the folded or foldable copies. A sensor pair, formed of the sensors 6 and 7, respectively, sensing two edge regions 8 and 9 of the folded or foldable copies 4 and 5, is energized in parallel by a supply line 13. Each of the sensors 6 and 7 is made up of a transmitting part 6.1 and 7.1, respectively, and of a receiving part 6.2 and 7.2, respectively. The detection of folded or foldable copies 4 and 5, respectively, takes place without contact between the two by radiation exchange 10.1. The output signals generated by the receiving part 6.2 or 7.2 of the respective sensor 6, 7 are combined and arrive as an input signal 15 corresponding to the combination at the paper jam or buildup-detection device 12. The latter is activated only by the signal 15 combined from the output signals of both receiving parts 6.2 and 7.2.

The paper jam or buildup-detection device 12 may either be provided with inverting inputs or else equipped with non-inverting inputs.

Figure 5A:
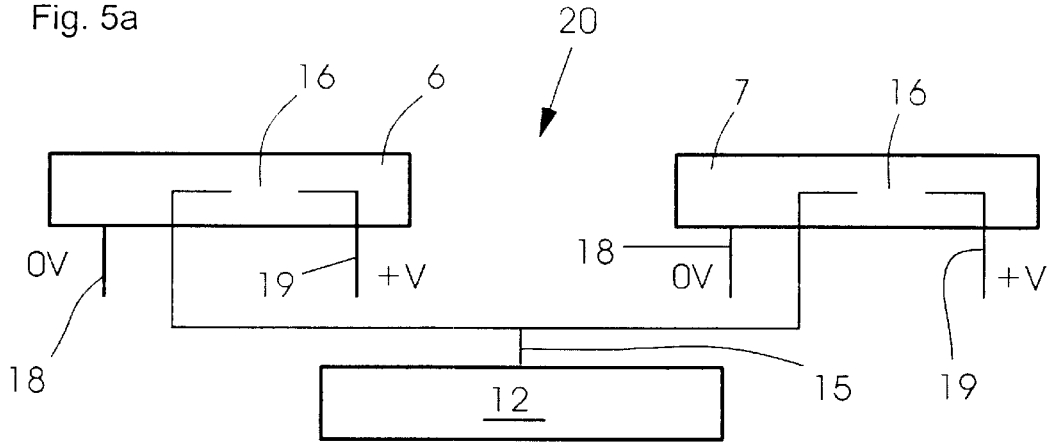
FIGS. 5*a*, 5*b* and 5*c* are respective fragmentary views of FIG.4 showing the sensor parts and receiving parts of the sensor pair in different contact states.
Figure 5B:
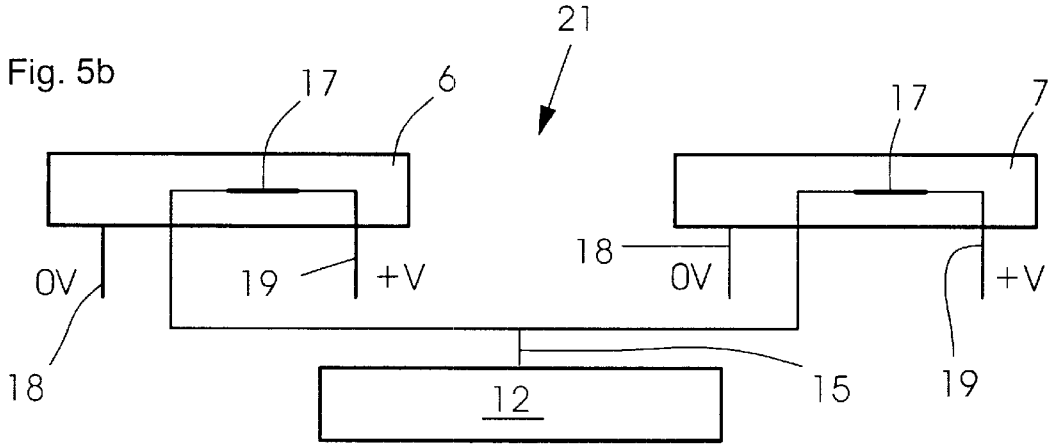
Figure 5C:
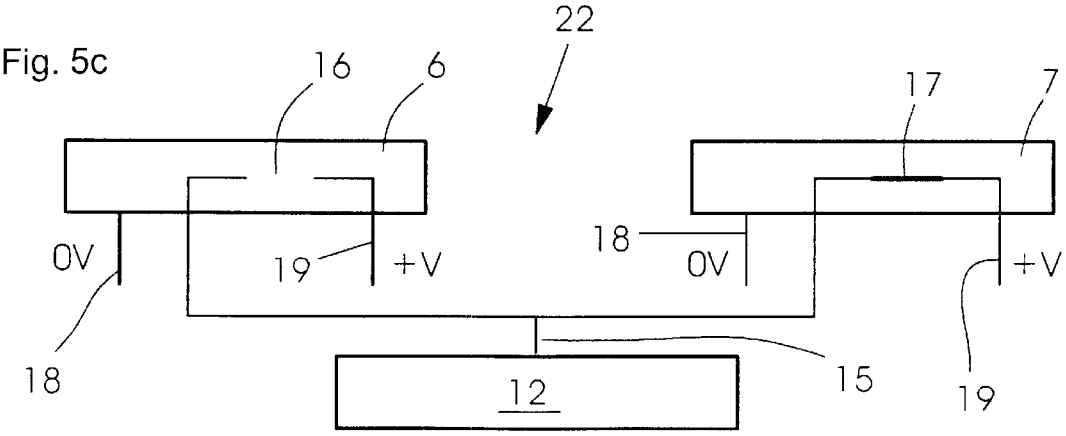

The manner in which the sensor pair functions is presented in greater detail in the illustration of the various contact states of the sensors 6 and 7, shown in FIGS. 5*a*, 5*b* and 5*c*.

The sensors 6 and 7 are connected at 18 to the 0V (zero voltage) level, and to a positive supply voltage +V at 19.

The sensors 6 and 7, in particular on the respective receiving parts 6.2 and 7.2, have electric contact elements 16 and 17 which can take on or assume an open or a closed state, respectively. In the state 20, both contacts 16, respectively, are open; the sensors 6 and 7 have both detected the presence of a folded or foldable copy 4, 5. A corresponding signal is picked off at the outputs of the respective receiving parts 6.2 and 7.2 of the sensors 6 and 7. This signal is transmitted as an input signal 15 to the paper jam or buildup-detection device 12. If the input of the latter is constructed as an inverting input, then, because the respective contacts 16 of both sensors 6 and 7 are open, and therefore there is no output signal, a counting pulse is triggered due to the inversion at the input 15 of the paper jam or buildup-detection system 12.

When the contacts 17 are closed in both sensors 6 and 7 according to the state 21, then, presupposing that the inputs on the paper jam or buildup-detection device 12 are inverted, the output signal being inverted when applied, there is no counting pulse in the paper jam or buildup-detection device 12.

According to the state identified by the reference numeral 22, on the sensors 6, 7, the contact elements 17 of a sensor 6 or 7, (here the sensor 7), are closed. However, the contact elements 17 of the sensor 6 are open, so that, after the output signals from the sensors 6 and 7 are combined, a positive output signal appears at the signal input 15 of the paper jam or buildup-detection device 12. This signal, inverted at the input of the paper jam or buildup-detection device 12, does not give rise to any triggering of a paper jam or buildup-detection signal, because only one of the sensors 6 or 7 had detected the presence of "paper", but not the opposite sensor. The triggering of a false paper jam or buildup detection by a paper shred or other object accidentally covering one of the sensors 6 or 7 is counteracted, with the result that the significant resulting circumstances occurring when a web-fed rotary printing machine is cut off can be avoided altogether and, in particular, the workload and therefore the productivity of web-fed rotary printing machines can be kept at the highest possible level.

In addition to the discussion of the inverting inputs of the paper jam or buildup-detection device 12 which was conducted in connection with the various states in FIGS. 5*a*, 5*b* and 5*c*, the inputs thereof may also be connected positively. The further processing of the input signal 15 in the case of a positive connection of the paper jam or buildup-detection device 12 and the triggering of a counting pulse then take place correspondingly.

Figure 6:
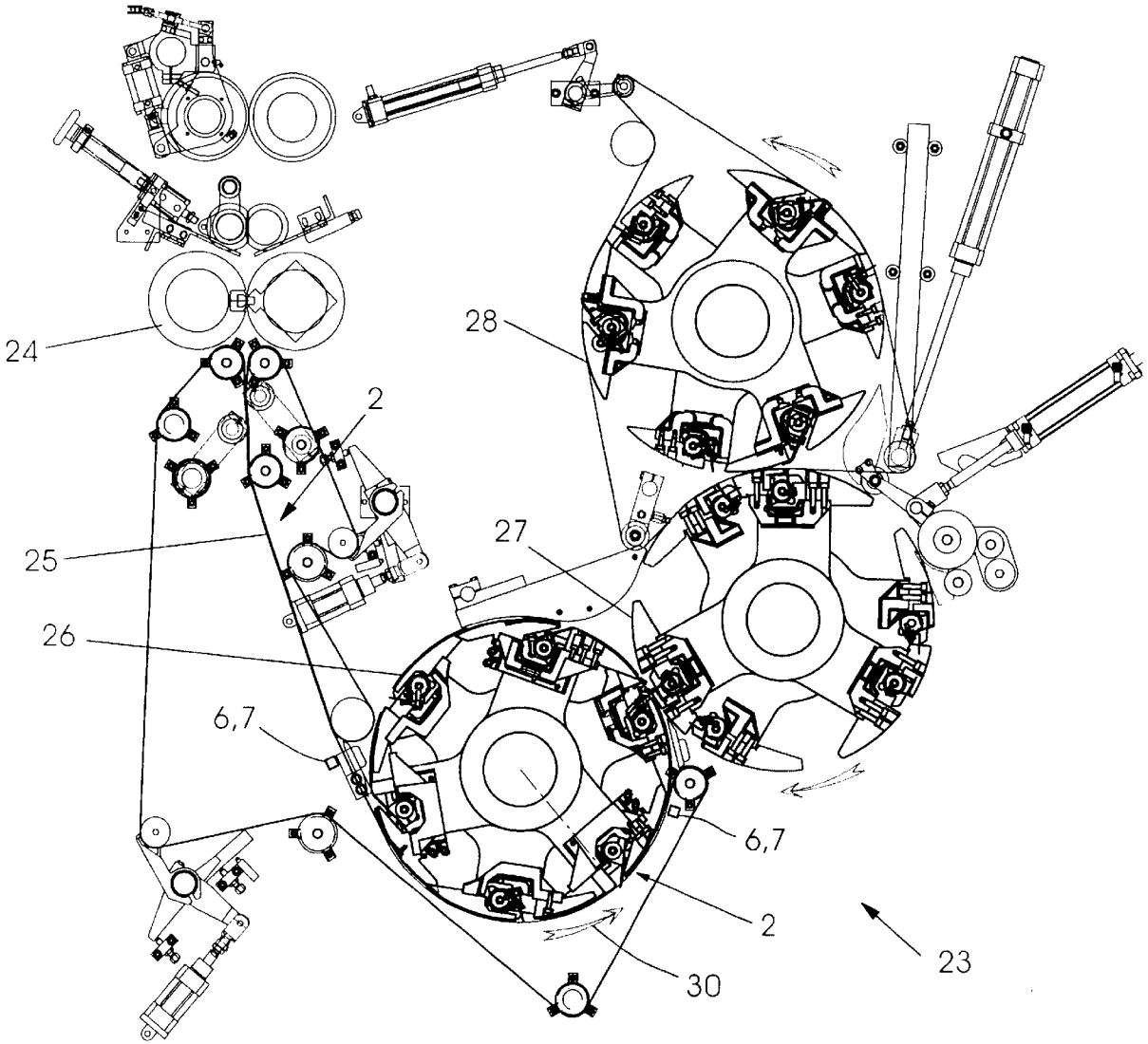
FIG. 6 is a diagrammatic side elevational view of a folder having a pinless operation, with sensor pairs integrated in the copy transport path.

FIG. 6 is a diagrammatic reproduction of a folder with pinless operation. The folder 23 includes a plurality of sensor pairs 6, 7 disposed along the copy transport path 2. In the illustration shown, the sensors 6 and 7 are arranged, in particular, at the cutting-cylinder pair 24, and also along the transport belt train 25. A further sensor pair 6, 7 is accommodated at an exit point downline of the transport belt train 25 before the transfer to the folding cylinder 26 of the copies 4 and 5, which are to be folded. On the circumference of the paper-guiding cylinder 26, the copies are conveyed in the direction of rotation 30 towards a point of transfer to a further paper-guiding cylinder 27, namely, a folding jaw cylinder. A further sensor pair 6, 7 may be arranged, either above or below the copy transfer point, in the wedge between the cylinders 26 and 27 guiding the foldable copies, in order to monitor the copy transfer. A sensor pair 6, 7 may likewise be accommodated at the transfer point between the folding jaw cylinder 27 and a transport cylinder 28 arranged above the latter.

The number of detached folded or foldable copies 4 and 5 can be inferred directly from the number of revolutions of the cutting-cylinder pair 24, and, in this regard, it is unimportant whether the cutting cylinder pair 24 is of the single-revolution or half-revolution type. From the conventional sensor positions along the copy transport path 2, reliable evidence as to whether or not there is a copy jam or buildup in the folder 23 is obtainable for each of the positions of the sensors 6 and 7 by the copy number comparisons determined in the paper jam or buildup-detection device 12.

We claim:

1. A method for detecting a copy jam or buildup in a folder, equipped with sensors disposed in the folder to monitor a copy transport path of the folder for detecting a sequence of copies along the copy transport path, the sensors, respectively, being formed of a transmitting part and a receiving part, the method which comprises placing sensors in the folder, connecting two of the sensors in parallel, simultaneously sensing two edge regions of a copy with the two sensors, and transmitting an input signal to a paper jam-detection device, in response to a presence of copies detected by the receiving parts of the two sensors; and producing a counting pulse with the input signal.

2. The method according to claim 1, which comprises providing the paper jam-detection system with inverting inputs for triggering the counting pulse when there is no voltage at the receiving parts.

3. The method according to claim 1, which includes continuously sensing the edge regions of the copies with the sensors.

4. The method according to claim 1, which includes comparing the number of revolutions of a cutting-cylinder pair with the number of copies passing the sensors for determining a paper jam in the folder.

5. The method according to claim 1, which includes failing to release a counting pulse when the input signal at the paper jam-detection device is based upon a voltage signal from only one of the receiving parts.

6. A system for detecting a copy jam in a folder, comprising:

a pair of parallel-connected sensors disposed in the folder to monitor a copy transport path of the folder for detecting a sequence of copies along the copy transport path, each of said sensors of said sensor pair being assigned to a respective one of two edge regions of the copies, and a paper jam-detection device connected to receive a combined signal from said sensors when each one of said sensors simultaneously indicates a presence of a copy in the copy transport path.

7. The system according to claim 6, wherein the sensors, respectively, are connected at one voltage level and have a live voltage-carrying output.

8. The system according to claim 6, wherein said voltage-carrying outputs are combined for generating an input signal to said paper jam-detection device.

9. The system according to claim 6, wherein the sensors, respectively, include both a transmitting part and a receiving part.

10. The system according to claim 9, wherein said receiving parts include switching elements and identical open contact positions for generating a counting pulse at said paper jam-detection device.

11. The system according to claim 10, wherein at least one closed contact on said receiving parts serves for generating an input signal which does not trigger a paper jam detection.

12. A folder with a copy transport path along which copies are transported in a continuous sequence, comprising:

a pair of parallel-connected sensors disposed in the folder to monitor the copy transport path of the folder, said sensors, respectively, including a transmitting part and a receiving part, each of said sensors of said sensor pair being assigned to a respective one of two edge regions of the copies, and a paper jam-detection device connected to receive a combined signal from said sensors when each one of said sensors simultaneously indicates a presence of a copy in the copy transport path.

* * * * *